US009415294B2

(12) United States Patent
Pino

(10) Patent No.: US 9,415,294 B2
(45) Date of Patent: Aug. 16, 2016

(54) BOARD SPORT EQUIPMENT CARRIER

(75) Inventor: Carmel Gonzales Pino, Houston, TX (US)

(73) Assignee: Carmel Gonzales Pino, Houston, TX (US)

( * ) Notice: Subject to any disclaimer, the term of this patent is extended or adjusted under 35 U.S.C. 154(b) by 0 days.

(21) Appl. No.: 14/126,806

(22) PCT Filed: Jun. 14, 2012

(86) PCT No.: PCT/US2012/042478

§ 371 (c)(1),
(2), (4) Date: Dec. 16, 2013

(87) PCT Pub. No.: WO2013/187903

PCT Pub. Date: Dec. 19, 2013

(65) Prior Publication Data

US 2015/0108194 A1 Apr. 23, 2015

(51) Int. Cl.

| | |
|---|---|
| ***A45F 3/04*** | (2006.01) |
| ***A63C 17/00*** | (2006.01) |
| ***A45F 4/02*** | (2006.01) |
| *A45F 3/02* | (2006.01) |
| *A45F 3/14* | (2006.01) |
| *A63C 17/01* | (2006.01) |

(52) U.S. Cl.

CPC ..... *A63C 17/0006* (2013.01); *A45F 3/04* (2013.01); *A45F 4/02* (2013.01); *A63C 17/002* (2013.01); *A45F 3/02* (2013.01); *A45F 2003/144* (2013.01); *A45F 2004/023* (2013.01); *A63C 17/01* (2013.01); *A63C 2203/44* (2013.01)

(58) Field of Classification Search

CPC ..... A45F 3/04

See application file for complete search history.

(56) References Cited

U.S. PATENT DOCUMENTS

| | | | | | |
|---|---|---|---|---|---|
| 4,790,460 | A | * | 12/1988 | Harper, Jr. | 224/644 |
| 5,016,794 | A | * | 5/1991 | Beagle, Jr. | 224/629 |
| 5,092,506 | A | * | 3/1992 | Bolduc | 224/658 |
| 5,344,056 | A | * | 9/1994 | Challoner et al. | 224/581 |
| 5,492,254 | A | * | 2/1996 | Challoner et al. | 224/586 |
| 5,934,533 | A | * | 8/1999 | Callanan | 224/651 |
| 5,988,474 | A | * | 11/1999 | Smith et al. | 224/578 |
| 6,010,051 | A | * | 1/2000 | Callanan | 224/651 |
| D455,259 | S | * | 4/2002 | Kelly-Pollet | D3/221 |
| D465,322 | S | * | 11/2002 | Gatien | D3/221 |
| 6,536,638 | B1 | * | 3/2003 | Gulmatico, III | 224/153 |
| 6,536,639 | B1 | * | 3/2003 | Frank | 224/257 |
| D474,888 | S | * | 5/2003 | Gillenwater | D3/261 |
| 6,585,137 | B1 | * | 7/2003 | Archuleta | 224/617 |
| 6,736,302 | B1 | * | 5/2004 | Brownlee | 224/607 |
| 6,799,707 | B2 | * | 10/2004 | Gibson | 224/609 |
| 6,832,711 | B2 | * | 12/2004 | Black | 224/628 |
| D510,801 | S | * | 10/2005 | Gillenwater | D3/261 |

(Continued)

FOREIGN PATENT DOCUMENTS

WO PCT/US2012/042478 6/2012

*Primary Examiner* — Justin Larson

(74) *Attorney, Agent, or Firm* — Carmel Gonzales Pino

(57) ABSTRACT

A board sport equipment carrier and method of use as a safety device wherein the equipment carrier can be configured in a carrier/backpack configuration for conveniently carrying the equipment of a board sport, or the carrier can be configured in a stowable configuration for storage between uses, or easy transportation, and finally in a folded wearable configuration where the device can be worn to protect the upper and middle spine, or the lower spine and coccyx of the wearer during board sport participation.

11 Claims, 4 Drawing Sheets

(56) References Cited

U.S. PATENT DOCUMENTS

| | | | | | |
|---|---|---|---|---|---|
| D524,539 | S | * | 7/2006 | Metzger et al. | D3/261 |
| D573,791 | S | * | 7/2008 | Metzger et al. | D3/261 |
| 7,568,599 | B2 | * | 8/2009 | Hall | 224/250 |
| D604,952 | S | * | 12/2009 | Metzger et al. | D3/261 |
| D607,640 | S | * | 1/2010 | Emile | D3/261 |
| D639,553 | S | * | 6/2011 | Reilly | D3/261 |
| 8,141,757 | B2 | * | 3/2012 | Headley | 224/153 |
| D695,006 | S | * | 12/2013 | Taylor | D3/216 |
| 8,752,746 | B2 | * | 6/2014 | Dee | 224/578 |
| D720,531 | S | * | 1/2015 | Judson et al. | D3/261 |
| 8,985,420 | B2 | * | 3/2015 | Dapkins et al. | 224/579 |
| 2004/0238585 | A1 | * | 12/2004 | Scarano | 224/613 |
| 2005/0218171 | A1 | * | 10/2005 | Bellerive | 224/576 |
| 2008/0277442 | A1 | * | 11/2008 | Crandall | 224/609 |

* cited by examiner

BOARD SPORT EQUIPMENT CARRIER

BACKGROUND OF THE INVENTION

Board sports have become quite popular with today's teens and young adults. Safety concerns require the use of padding, helmets, and other gear which must be transported from location to location. Carrying gear while riding a bicycle or motorbike can be unsafe and cause accidents or damage to gear. Simply walking with your arms loaded with gear can be a nuisance.

Carriers have been around in one form or another, but the carriers had to be left on the sidelines while participating in the board sport, tying the user to a central location where they must return for the rest of their gear. The alternatives were to have a carrier hanging from one's waist or back where it could interfere with sports participation.

DETAILED DESCRIPTION OF THE PREFERRED EMBODIMENTS

Figure 1:
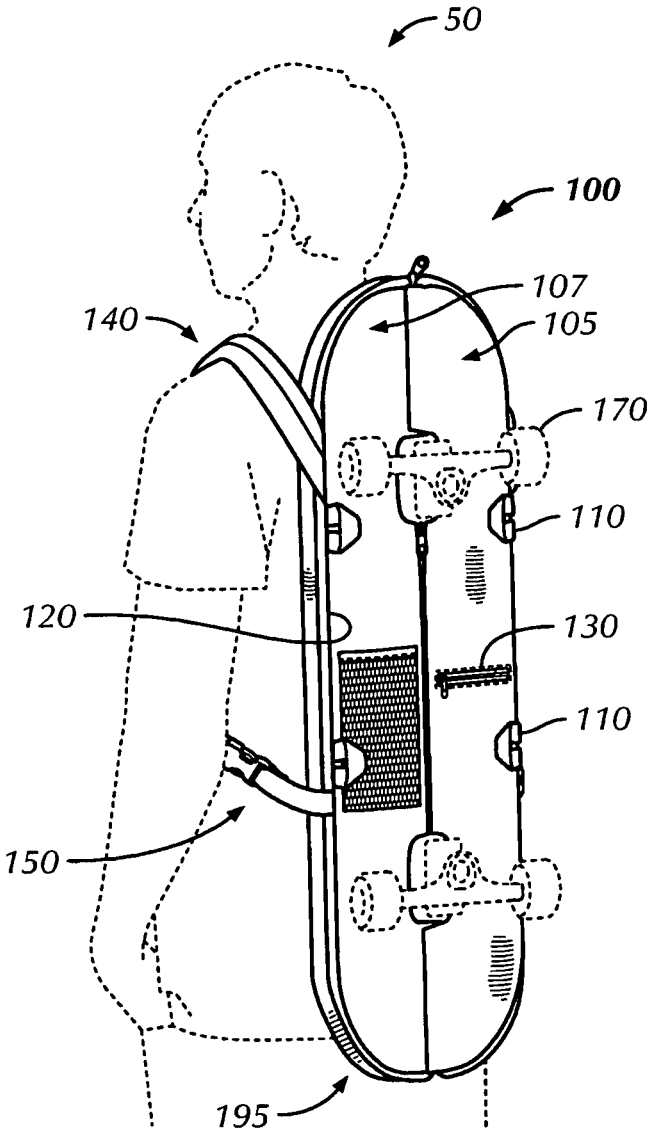
FIG. 1 illustrates a skateboard in phantom shown transported in a carrier on the back of a board sport participant in accordance with an exemplary embodiment of the invention.

Described herein is a board sport equipment carrier which may be utilized to transport equipment utilized in participation of board sports. Board sports commonly include any sport where a "board" like component is ridden or utilized in transportation from location to location. Common board sports include, but are not limited to skateboarding, snowboarding, wakeboarding, kite boarding, sand boarding, paddle boarding, and skim boarding. For the sake of clarity, the remainder of this discussion shall be limited to skateboarding, but one skilled in the arts would appreciate that it would apply to other board sports as well.

The equipment carrier substantially encompasses the board with a right and left front side which overlap at a vertical line from the top to the bottom of the padded back panel and join in the center with optional openings to allow trucks of the skateboard to protrude from the encompassing compartment. The left and right sides may join in the center with hook and loop fastener, snaps, zippers, clips, or a variety of other methods which would be obvious to one skilled in the art.

The back panel of the compartment comprises a padded material to provide comfort to the user when worn on the back. The back panel faces the wearer's back and thus is situated between the board and the users back. Straps are situated on either side of the compartment and are worn in a standard backpack configuration.

Extra loops, straps and/or fasteners sewn to the external edges of the compartment allow additional sports gear to be fastened to the carrier securing all gear in a single bundle. Pockets both external and internal to the compartment are included for loose items and smaller accessories. The straps optionally have padded shoulders and adjustable lengths to accommodate various sized wearers in optimum comfort. Optional male and female claps may also be included to allow the user to more easily enter and exit the straps, and to cross the straps to more securely fasten it to the body.

The compartment has a single zipper which comprises the bottom stop at one end of the elongated compartment and the top stops at the other end. The tape is sewn to the perimeter of the padded back panel with the chain facing out from the compartment. By folding the back panel lengthwise along the vertical center of the compartment and folding straps to the inside, the two chains of the zipper may be joined so the slider may be moved from the top stops to the bottom stops or vice versa to close the carrier into a folded configuration.

The padded back of the compartment comprises a resealable pocket on at least one side which is openable to the outside when the carrier is in the folded configuration. This pocket allows for storage of change, keys, or other small accessories which may need to be easily accessible without opening the entire carrier from the folded configuration.

The padded back further comprises two end pockets, one at the top and one at the bottom. These pockets may be off center so as to be completely located in one half such that they are on the same side when the carrier is in the folded configuration. These end pockets may be utilized to stow a strap, one end of which is secured to the inside of the pocket, the other end of which is configured with a mating system for joining to the other strap. These strap and the fasteners and optional adjusters included thereon may be stowed inside the pocket which may be closed to secure the straps in the stowed arrangement. In such a folded configuration with the straps stowed in the ends, the folded container is in a stowable configuration with no loose parts to catch.

By opening the resealable end pockets, the straps can be extended from the pocket and then curved around and joined end to end to form a loop thus forming a folded wearable configuration. In the wearable configuration, the carrier may be worn around the waist, over a shoulder, or across the body. In the wearable configuration, the padded back is doubled and enclosing the padded shoulder straps such that it has sufficient thickness to provide safety padding for the wearer. Worn around the waist, in a "fanny-pack" like manner the carrier provides protection to the lower back and coccyx (tail bone), which may otherwise be injured in a fall. Worn across the body, the carrier provides protection for the spine. In either configuration, the side pocket is easily accessible without need to open the carrier from the folded configuration.

If the carrier is open and worn in the backpack configuration, then the side pocket would be situated between the carrier and the wearer's back providing a level of security in that the pocket could not be easily accessed without the wearer's knowledge. This makes the side pocket an ideal location for storing valuables such as money or identification.

FIG. 1 illustrates a skateboard in phantom shown transported in a carrier on the back of a board sport participant in accordance with an exemplary embodiment of the invention. A wearer (50 in phantom,) is shown with a carrier (100) transporting a skateboard (170, in phantom). The carrier (100) comprises a padded back (195) which is joined with a right side panel (105) and a left side panel (107) to form a compartment for encompassing a board (170). The carrier (100) comprises a plurality of pockets (120, 130) which may be open mesh pockets (120) or enclosed resealable pockets (130). The edges of the carrier are embellished with a plurality of loops, fasteners, or straps (110) for securing accessories (not shown). The carrier (100) has shoulder straps (140) which may be adjustable (155) and detachable (150).

Figure 2:
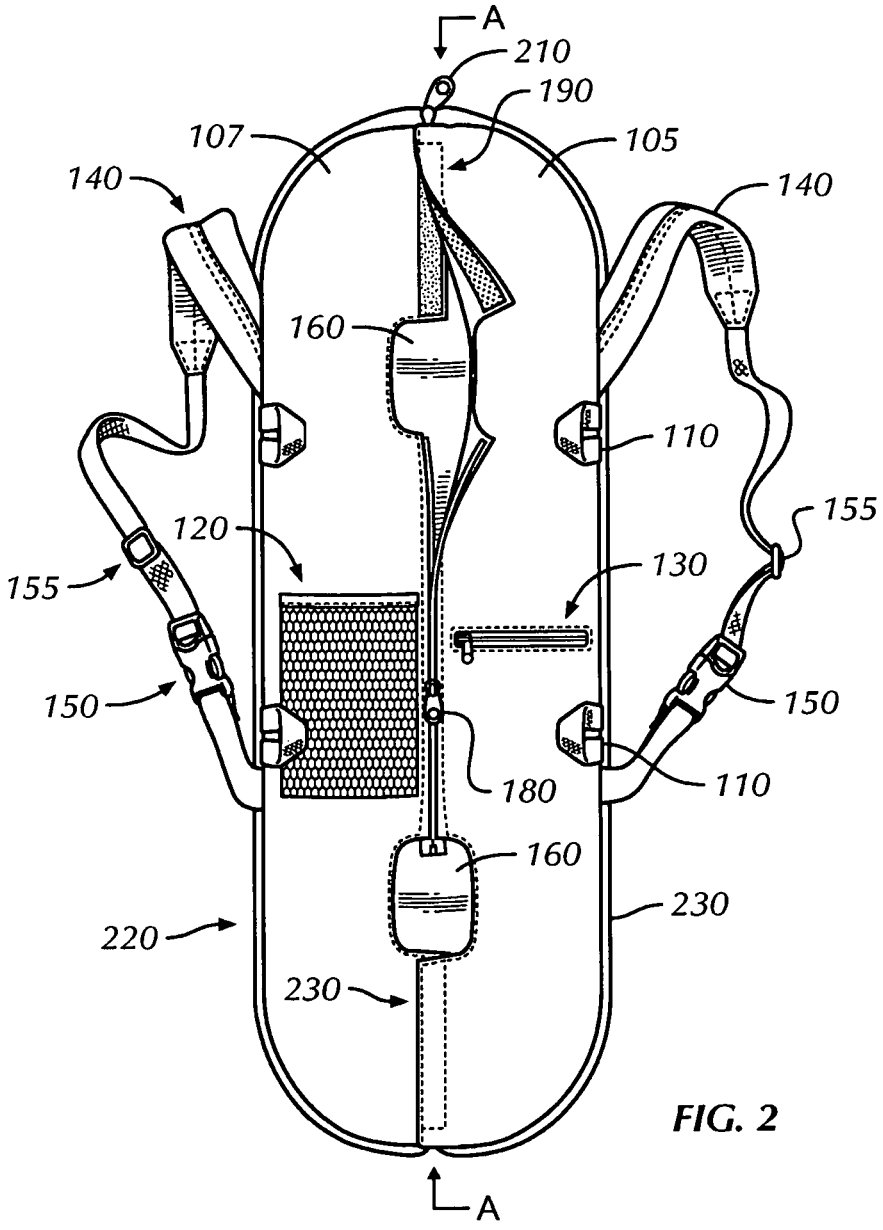
FIG. 2 illustrates one embodiment of a carrier in an open configuration in accordance with an exemplary embodiment of the invention.

FIG. 2 illustrates one embodiment of a carrier in an open configuration in accordance with an exemplary embodiment of the invention. In this figure, the components of the carrier (100) are clearly shown to include a right panel (105) and a left panel (107) which join along a center line (A-A) and fasten with a zipper (180) and/or hook and loop fastener (190). One skilled in the art would appreciate that other fastening methods would also accomplish the task and be within the teachings of this disclosure. The panels contain optional openings (160) which accommodate the protrusion of components of the board such as trucks, wheels, or bindings.

The right panel (105) comprises a resealable pocket (130) which is illustrated here with a zipper. One skilled in the art would appreciate that other forms of sealing the pocket including but not limited to buttons, hook and loop, etc. would also be within this disclosure's teachings. The left panel (107) comprises a mesh pocket. The pockets of the right and left panel may be transposed, or may differ in number.

The perimeter of the carrier contains a zipper which is illustrated with the pull (210) at the top of the center line (A-A) and bottom stops (not illustrated) at the bottom of the center line (A-A). The chains of the zipper are situated along the edges of the carrier (220, 230), and would pass behind the padded shoulder straps (140) and their adjustable hardware (155) and removable hardware (150) such that the straps (140) would be on the interior when the carrier is folded into the closed configuration.

Figure 3:
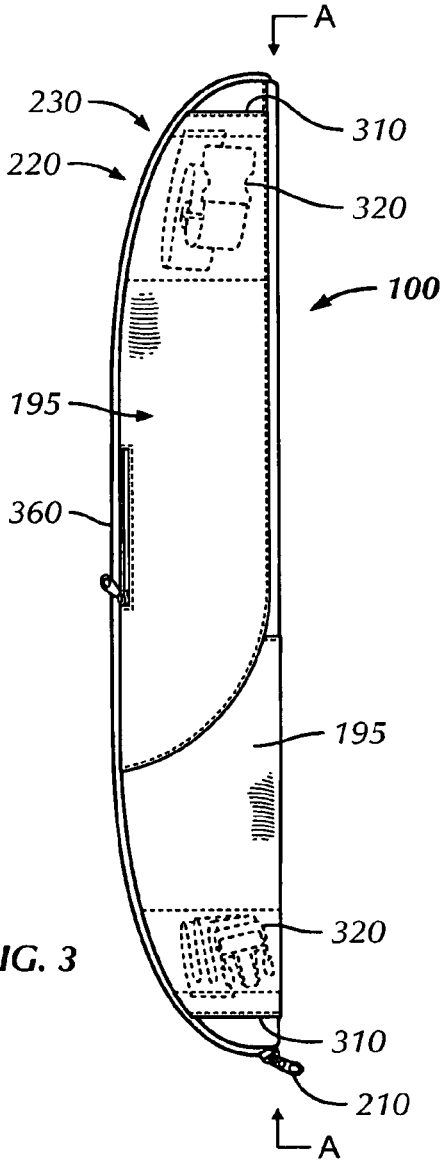
FIG. 3 illustrates one embodiment of a carrier in a folded and storable configuration in accordance with an exemplary embodiment of the invention.

FIG. 3 illustrates one embodiment of a carrier in a folded and storable configuration in accordance with an exemplary embodiment of the invention. The carrier (100) has been folded along its vertical center line (A-A) with the padded back (195) on the outside and the zipper's chains (220,230) has been zipped closed by the pull (210) such that the shoulder straps (150, not illustrated) and the accessory attachment points (110, not illustrated) are stored on the inside. Visible in this configuration are the top and bottom pockets (310) which contain straps (320, shown in phantom). The side pocket (360) is also visible with a zippered opening.

Figure 4:
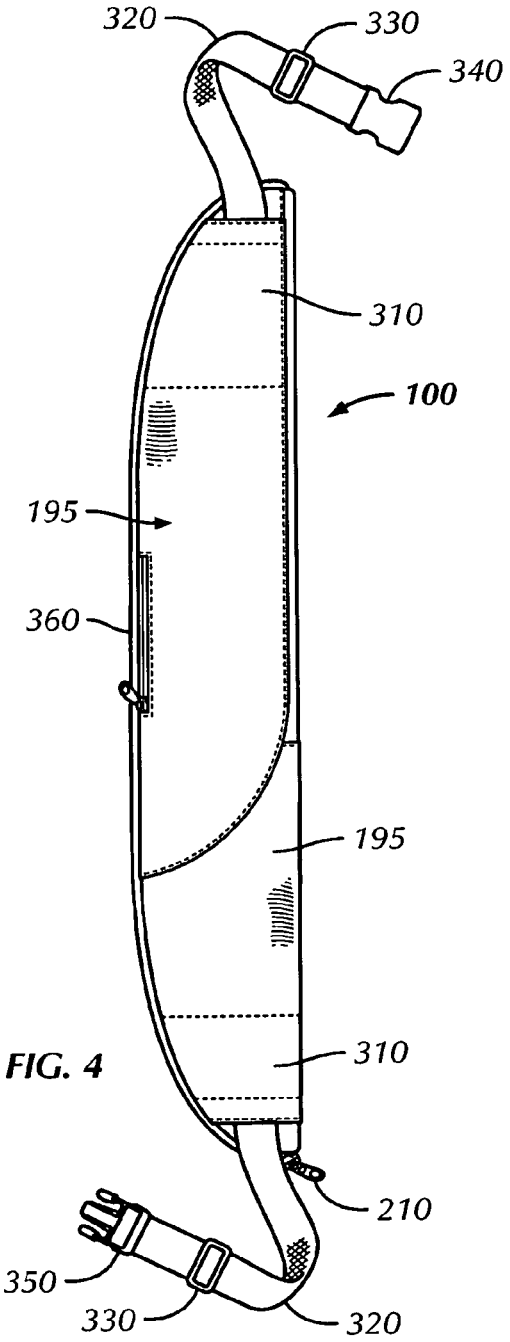
FIG. 4 illustrates one embodiment of a carrier in a folded wearable configuration with extended end straps in accordance with an exemplary embodiment of the invention.

FIG. 4 illustrates one embodiment of a carrier in a folded wearable configuration with extended end straps in accordance with an exemplary embodiment of the invention. To convert the carrier from the folded and storable configuration (FIG. 3) to the folded wearable configuration (FIG. 4) one simply opens the top and bottom pockets (310) and removes the straps (320) which are illustrated with optional length adjustments (330) and a male (340) and female (350) clasping mechanism.

Figure 5:
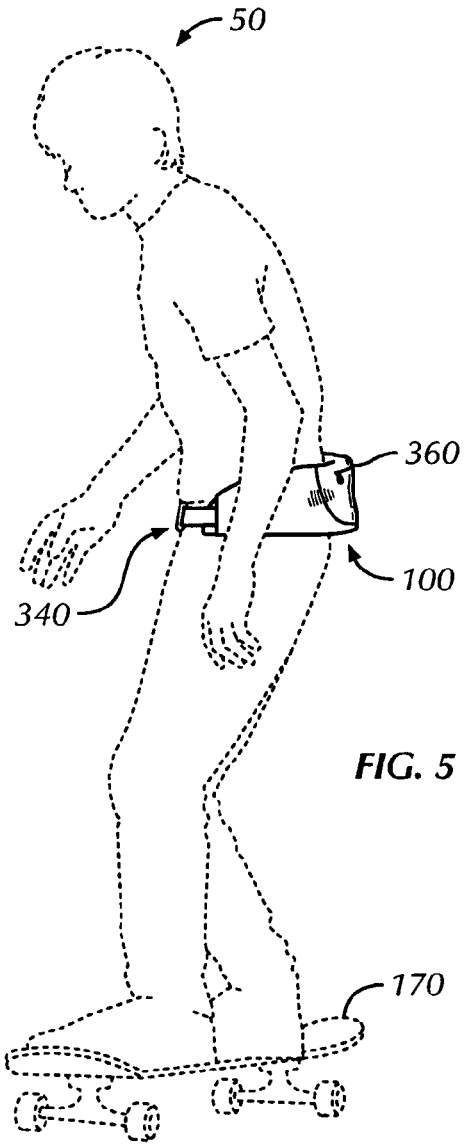
FIG. 5 illustrates one embodiment of a user utilizing a carrier in a folded wearable configuration around the waist in accordance with an exemplary embodiment of the invention.

FIG. 5 illustrates one embodiment of a user utilizing a carrier in a folded wearable configuration around the waist in accordance with an exemplary embodiment of the invention. The wearer (50) has positioned the carrier (100) in the folded wearable configuration around the waist with the clasping mechanism (340, 350 obscured) in the front and the carrier's (100) main body in the back covering the lower back and coccyx. The side pocket (360) is easily accessible in this configuration.

Figure 6A:
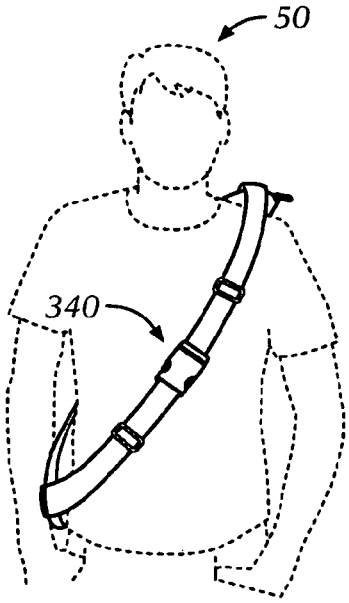
FIG. 6 illustrates a front and rear view of a user utilizing an embodiment of the carrier in a folded wearable configuration in accordance with an exemplary embodiment of the invention.
Figure 6B:
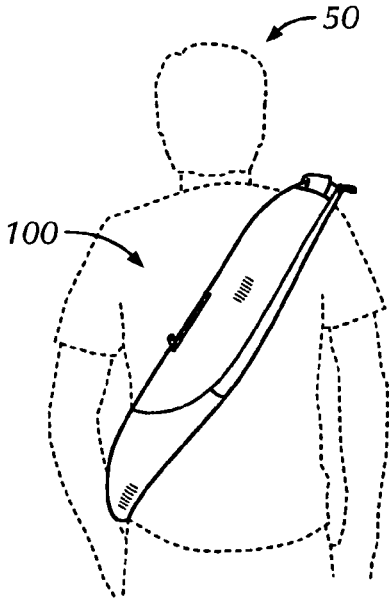

FIG. 6 illustrates a front and rear view of a user utilizing an embodiment of the carrier in a folded wearable configuration in accordance with an exemplary embodiment of the invention. FIG. 6A illustrates the user (50) with the carrier (100, obscured) in a folded wearable configuration, worn over one shoulder and under the opposite arm, with the clasping mechanism (340; 350 obscured) in the middle front of the torso of the user (50). FIG. 6B illustrates the user (50) wearing the carrier (100) in the same configuration to protect the upper and middle spine.

The diagrams in accordance with exemplary embodiments of the present invention are provided as examples and should not be construed to limit other embodiments within the scope of the invention. For instance, heights, widths, and thicknesses may not be to scale and should not be construed to limit the invention to the particular proportions illustrated. Additionally some elements illustrated in the singularity may actually be implemented in a plurality. Further, some element illustrated in the plurality could actually vary in count. Further, some elements illustrated in one form could actually vary in detail. Further yet, specific numerical data values (such as specific quantities, numbers, categories, etc.) or other specific information should be interpreted as illustrative for discussing exemplary embodiments. Such specific information is not provided to limit the invention.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A board sport equipment carrier, comprising:

a back panel, a left front side panel, and a right front side panel;

wherein said left and right front side panels are respectively joined to left and right sides of said back panel to form a board enclosing compartment;

wherein at least one of said back, left front side, and right front side panels is padded;

a zipper including a pair of mating zipper chains each respectively extending around left and right portions of a peripheral outermost edge of said enclosing compartment;

wherein said carrier is foldable along a vertical center line such that said zipper chains are joined to form a folded configuration in which said carrier provides padded impact protection to the user;

a pair of shoulder straps, and a waist strap including first and second portions each respectively extending from upper and lower ends of said carrier for carrying said carrier about a user's waist or torso when in said folded configuration, said first and second waist strap portions when not in use being respectively stored in a pair pockets located one each at said upper and lower ends of said carrier.

2. The board sport equipment carrier of claim 1, wherein said left and right front side panels overlap and are removably joined along a vertical center line.

3. The board sport equipment carrier of claim 1, wherein said left and right front side panels are removably joined by hook and loop fasteners.

4. The board sport equipment carrier of claim 1, wherein said left and right front side panels are removably joined by a zipper.

5. The board sport equipment carrier of claim 1, further comprising a plurality of openings allowing the protrusion of board trucks or binders.

6. The board sport equipment carrier of claim 1, further comprising at least one attachment point on an outside of said enclosing compartment for accessory attachment.

7. The board sport equipment carrier of claim 1, wherein said shoulder straps are padded and are enclosed within said carrier in said folded configuration to provide safety padding for the user.

8. The board sport equipment carrier of claim 1, where said shoulder straps are removably attachable to said left and right front side panels.

9. The board sport equipment carrier of claim 1, wherein said shoulder straps and said waist strap are adjustable in length.

10. The board sport equipment carrier of claim 1, wherein said back panel is padded.

11. The board sport equipment carrier of claim 1, wherein said back panel further comprises a reclosable pocket or opening accessible from an outside of said carrier when in said folded configuration.

* * * * *